US008939741B2

(12) United States Patent
Seong et al.

(10) Patent No.: US 8,939,741 B2
(45) Date of Patent: Jan. 27, 2015

(54) SCROLL COMPRESSOR

(75) Inventors: Sanghun Seong, Seoul (KR); Cheolhwan Kim, Seoul (KR); Sungyong Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 82 days.

(21) Appl. No.: 13/454,137

(22) Filed: Apr. 24, 2012

(65) Prior Publication Data

US 2012/0275946 A1 Nov. 1, 2012

(30) Foreign Application Priority Data

Apr. 28, 2011 (KR) ..... 10-2011-0040386

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F01C 21/02*** | (2006.01) |
| ***F04C 23/00*** | (2006.01) |

(Continued)

(52) U.S. Cl.

CPC ..... *F01C 21/02* (2013.01); *F04C 23/008* (2013.01); *F04C 29/0071* (2013.01); *F04C 18/0215* (2013.01); *F04C 18/0253* (2013.01); *F04C 2240/10* (2013.01)

USPC ..... 418/55.1; 418/55.2; 418/55.3; 418/55.4; 418/55.5; 418/55.6; 418/54

(58) Field of Classification Search

CPC .... F01C 21/02; F04C 23/008; F04C 18/0215; F04C 29/0071; F04C 18/0253; F04C 2240/10

USPC ..... 418/55.1–55.6, 54

See application file for complete search history.

(56) References Cited

U.S. PATENT DOCUMENTS

| | | | | |
|---|---|---|---|---|
| 4,303,379 | A | 12/1981 | Hiraga et al. | 418/55.2 |
| 4,655,696 | A | 4/1987 | Utter | 418/55.3 |

(Continued)

FOREIGN PATENT DOCUMENTS

| | | |
|---|---|---|
| DE | 100 09 673 | 9/2000 |
| EP | 0 348 936 A2 | 1/1990 |

(Continued)

OTHER PUBLICATIONS

United States Office Action dated Nov. 25, 2013 issued in U.S. Appl. No. 13/454,152.

(Continued)

*Primary Examiner* — Kenneth Bomberg
*Assistant Examiner* — Deming Wan
(74) *Attorney, Agent, or Firm* — Ked & Associates, LLP

(57) ABSTRACT

A scroll compressor is provided that may include a fixed scroll having a fixed wrap, an orbiting scroll engaged with the fixed wrap to define a compression chamber, a rotation shaft having a shaft portion eccentrically located with respect to the orbiting scroll, a pin portion located at an end of the shaft portion and having a diameter smaller than a diameter of the shaft portion, and a bearing located at an end of the pin portion, and a drive that drives the rotation shaft. The pin portion may be inserted through one of the fixed scroll or the orbiting scroll, and the orbiting scroll may be rotatably coupled to the bearing.

22 Claims, 16 Drawing Sheets

(51) Int. Cl.
*F04C 29/00* (2006.01)
*F04C 18/02* (2006.01)

(56) References Cited

U.S. PATENT DOCUMENTS

| | | | | | |
|---|---|---|---|---|---|
| 4,774,816 | A | | 10/1988 | Uchikawa et al. | 418/55.1 |
| 5,017,108 | A | * | 5/1991 | Murayama et al. | 418/55.6 |
| 5,775,893 | A | * | 7/1998 | Takao et al. | 418/55.2 |
| 5,800,141 | A | | 9/1998 | Ceylan et al. | 418/55.1 |
| 6,030,192 | A | * | 2/2000 | Hill et al. | 418/55.2 |
| 6,053,714 | A | * | 4/2000 | Fenocchi et al. | 418/55.1 |
| 6,301,912 | B1 | | 10/2001 | Terai et al. | 62/228.4 |
| 6,379,131 | B1 | | 4/2002 | Hoashi | 417/440 |
| 6,464,470 | B1 | | 10/2002 | Zamudio et al. | 417/297 |
| 6,579,080 | B1 | | 6/2003 | Spinnler | 418/55.2 |
| 6,932,586 | B2 | | 8/2005 | Furusho et al. | 418/55.5 |
| 7,371,059 | B2 | | 5/2008 | Ignatiev et al. | 418/151 |
| 7,909,592 | B2 | | 3/2011 | Yano et al. | 418/55.1 |
| 8,308,460 | B2 | * | 11/2012 | Seong et al. | 418/55.2 |
| 2001/0014293 | A1 | | 8/2001 | Tsumagari et al. | 418/55.4 |
| 2002/0039540 | A1 | | 4/2002 | Kuroki et al. | 418/55.5 |
| 2006/0159567 | A1 | * | 7/2006 | Tazoe et al. | 417/410.3 |
| 2012/0134864 | A1 | | 5/2012 | Lee et al. | 418/66 |
| 2012/0230855 | A1 | | 9/2012 | Seong et al. | 418/55.2 |

FOREIGN PATENT DOCUMENTS

| | | |
|---|---|---|
| EP | 1 507 085 | 2/2005 |
| GB | 2 167 132 | 5/1986 |
| JP | 2-19678 | 1/1990 |
| JP | 7-269478 | 10/1995 |
| JP | 10-246188 | 9/1998 |
| JP | 2000-18179 | 1/2000 |
| JP | 2001-182677 | 7/2001 |
| JP | 2002-89463 | 3/2002 |
| JP | 2007-100713 | 4/2007 |
| KR | 10-0311888 | 11/2001 |
| KR | 10-0395163 | 8/2003 |
| KR | 10-2009-0077294 | 7/2009 |
| KR | 10-1059880 | 8/2011 |
| WO | WO 96/20345 | 7/1996 |
| WO | WO 2007/114531 | 10/2007 |

OTHER PUBLICATIONS

European Search Report dated Jan. 28, 2014.
European Search Report dated Jan. 29, 2014.
Office Action dated Jun. 5, 2014, issued in U.S. Appl. No. 13/598,673.
Office Action dated Jun. 30, 2014, issued in U.S. Appl. No. 13/649,310.

* cited by examiner

SCROLL COMPRESSOR

BACKGROUND

1. Field

A scroll compressor is disclosed herein.

2. Background

Scroll compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Hereinafter, description will be made in detail to embodiments of a scroll compressor with reference to the accompanying drawings.

A scroll compressor is a compressor, which includes a fixed scroll having a fixed wrap and an orbiting scroll having an orbiting wrap engaged with the fixed wrap. With this configuration of a scroll compressor, as the orbiting scroll orbits on the fixed scroll, volumes of compression chambers, which are formed between the fixed wrap and the orbiting wrap, consecutively change, thereby sucking and compressing a refrigerant. The scroll compressor allows suction, compression, and discharge to be consecutively performed, and it is very favorable, in comparison to other types of compressors, with respect to vibration and noise generated during operations.

The orbiting scroll may include a disk, and the orbiting wrap may be located at one side of the disk. A boss may be formed at a rear surface, on which the orbiting wrap is not formed, and may be connected to a rotation shaft, which allows the orbiting scroll to perform an orbiting motion. The orbiting wrap may be formed on almost an entire surface of the plate, thereby reducing a diameter of the disk for obtaining the same compression ratio. On the other hand, a point of application, to which a repulsive force of a refrigerant is applied upon compression, may be perpendicularly spaced apart from a point of application, to which a reaction force is applied to attenuate the repulsive force. Accordingly, the orbiting scroll may be inclined during operation, thereby generating more vibration and/or noise.

To obviate such problems, a scroll compressor having a coupled portion of a rotation shaft and an orbiting scroll located at or on the same surface as an orbiting wrap has been introduced. Such structure allows the repulsive force of the refrigerant and the reaction force to be applied to the same point to solve the inclination issue of the orbiting scroll. However, when the rotation shaft extends up to the orbiting wrap, an end portion of the rotation shaft may penetrate through a disk of the orbiting scroll. Accordingly, a shaft insertion hole having a diameter as wide as a diameter of the rotation shaft is needed at or in the disk of the orbiting scroll. However, this structure causes a strength of the disk to be reduced. In addition, as the diameter of the shaft insertion hole formed at or in the disk increases, leakage of the compressed refrigerant may result.

Figure 1:
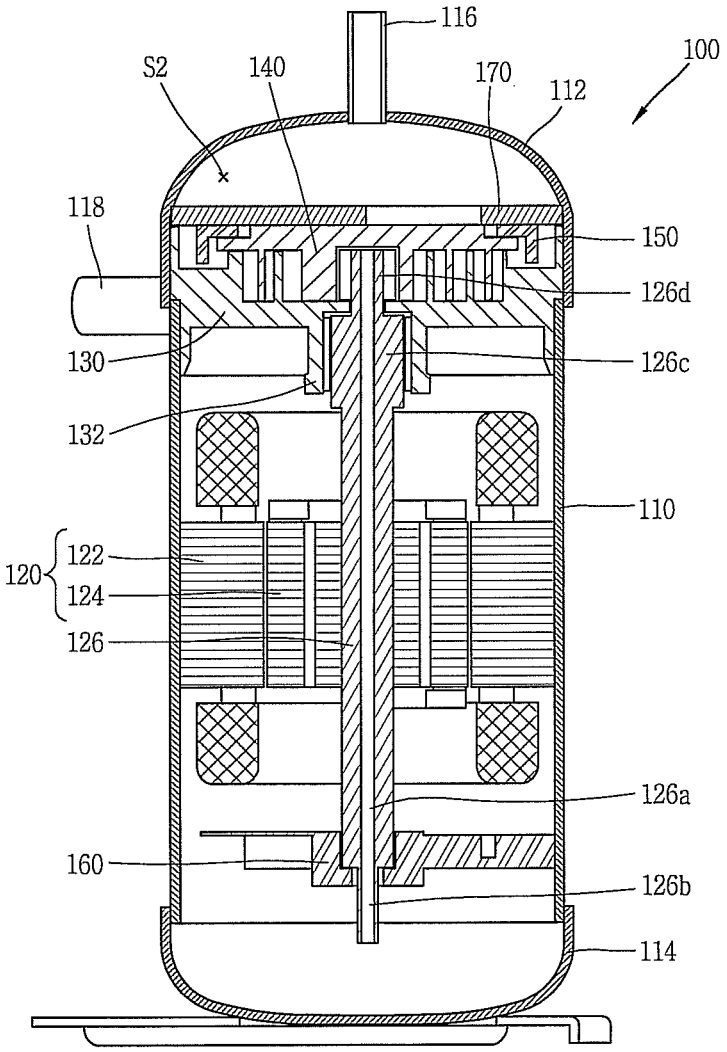
FIG. 1 is a schematic sectional view of an inner structure of a scroll compressor in accordance with an embodiment.
Figure 2:
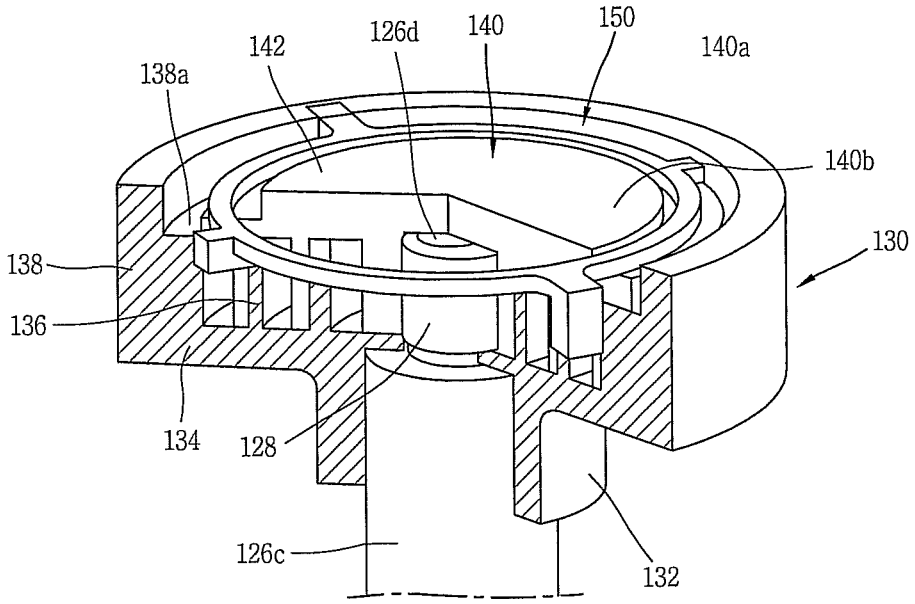
FIG. 2 is a partial cut view of a compression device of the scroll compressor of FIG. 1.
Figure 3:
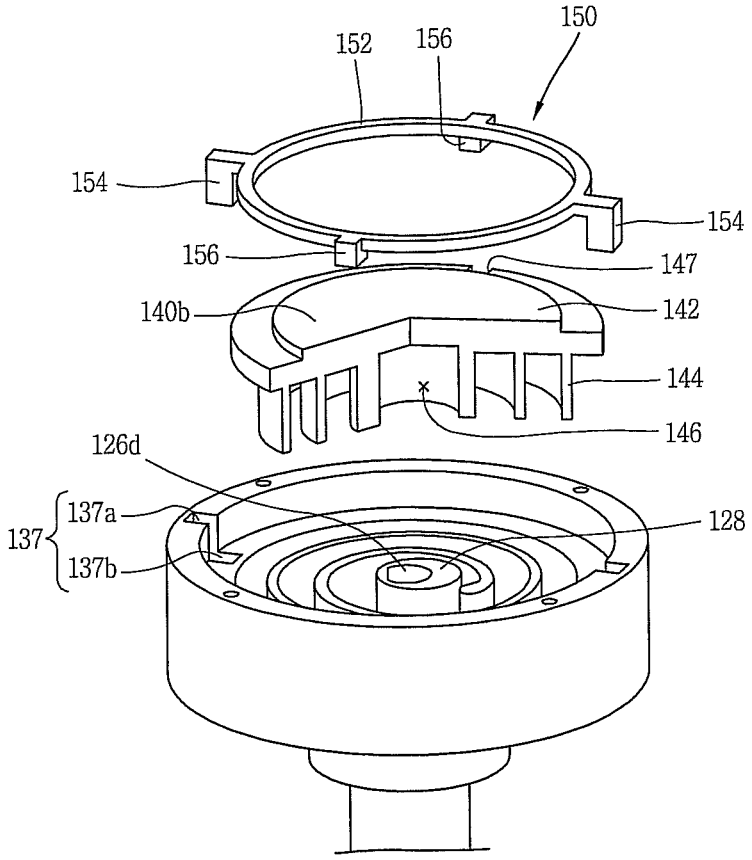
FIG. 3 is a disassembled perspective view of the compression device of FIG. 2.

FIG. 1 is a schematic sectional view of an inner structure of a scroll compressor in accordance with an embodiment. FIG. 2 is a partial cut view of a compression device of the scroll compressor of FIG. 1, while FIG. 3 is a disassembled perspective view of the compression device of FIG. 2.

As shown in FIG. 1, scroll compressor 100 may include a casing 110, which may be in a cylindrical shape, and an upper shell 112 and a lower shell 114 that cover upper and lower portions of the casing 110. The upper and lower shells 112 and 114 may be, for example, welded to the casing 110, so as to define a single hermetic space together with the casing 110.

A discharge pipe 116 may be connected to an upper side of the upper shell 112. The discharge pipe 116 may act as a path through which a compressed refrigerant may be discharged to outside of the scroll compressor 100. An oil separator (not shown) that separates oil mixed with the discharged refrigerant may be connected to the discharge pipe 116. A suction pipe 118 may be installed at a side surface of the casing 110. The suction pipe 118 may act as a path through which a refrigerant to be compressed may be introduced into the scroll compressor 100. Referring to FIG. 1, the suction pipe 118 may be located at an interface between the casing 110 and the upper shell 112; however, other positions of the suction pipe 118 may also be appropriate. In addition, the lower shell 114 may function as an oil chamber that stores oil, which may be supplied to make the compressor to allow it to smoothly work or function.

A motor 120, which may function as a drive, may be installed at an approximately central portion within the casing 110. The motor 120 may include a stator 122, which may be fixed to an inner surface of the casing 110, and a rotor 124, which may be located within the stator 122 and rotatable by interaction with the stator 122. A rotation shaft 126 may be disposed in or at a center of the rotor 124 so as to be rotatable together therewith.

An oil passage 126*a* may be formed in or at a center of the rotation shaft 126 and may extend along a lengthwise direction of the rotation shaft 126. An oil pump 126*b* that pumps up oil stored in the lower shell 114 may be installed at a lower end portion of the rotation shaft 126. The oil pump 126*b* may be implemented, for example, by forming a spiral recess or separately installing an impeller in the oil passage 126*a*, or may be a separate pump, which may be attached or welded thereto.

A diameter-extended portion 126*c*, which may be inserted in a boss formed in a fixed scroll, which will be explained hereinafter, may be disposed at an upper end portion of the rotation shaft 126. The diameter-extended portion 126*c* may have a diameter greater than a diameter of other portions of the rotation shaft 126. A pin portion 126*d* may be formed at an end of the diameter-extended portion 126*c*. It is noted that the diameter-extended portion may be omitted; that is, the entire rotation shaft 126 may have a specific diameter.

An eccentric bearing 128 may be inserted onto the pin portion 126*d*. Referring to FIG. 3, the eccentric bearing 128 may be eccentrically inserted onto the pin portion 126*d*. A coupled portion between the pin portion 126*d* and the eccentric bearing 128 may be in the shape of the letter "D", such that the eccentric bearing 128 cannot be rotated with respect to the pin portion 126*d*. In addition, the pin portion 126*d* may have a polygonal or non-circular shape. Even in the case of the pin portion 126*d* having a circular section, the pin portion 126*d* may be, for example, welded or shrink-fitted to the eccentric bearing 128, such that the eccentric bearing 128 cannot rotate.

A fixed scroll 130 may be mounted at a boundary portion between the casing 110 and the upper shell 112. The fixed scroll 130 may have an outer circumferential surface, which may be shrink-fit between the casing 110 and the upper shell 112. Alternatively, the fixed scroll 130 may be, for example, welded with the casing 110 and the upper shell 112.

A boss 132, in which the rotation shaft 126 may be inserted, may be formed at a lower surface of the fixed scroll 130. A through hole, through which the pin portion 126*d* of the rotation shaft 126 may be inserted, may be formed through an upper surface (see FIG. 1) of the boss 132. Accordingly, the pin portion 126*d* may protrude to an upper side of a disk 134 of the fixed scroll 130 through the through hole.

A fixed wrap 136, which may be engaged with an orbiting wrap, which will be explained hereinafter, so as to define compression chambers, may be formed at an upper surface of the disk 134. A side wall 138 may be located at an outer circumferential portion of the disk 134. The side wall 138 may define a space that houses an orbiting scroll 140, which will be explained later, and may contact an inner circumferential surface of the casing 110. An orbiting scroll support 138*a*, on which an outer circumferential portion of the orbiting scroll 140 may be supported, may be formed inside at an upper end portion of the side wall 138. A height of the orbiting scroll support 138*a* may have the same height as a height of the fixed wrap 136 or a height slightly higher than the fixed wrap 136, such that an end of an orbiting wrap 144 may contact a surface of the disk 134 of the fixed scroll 130.

The orbiting scroll 140 may be disposed on the fixed scroll 130. The orbiting scroll 140 may include a disk 142, which may have an approximately circular shape, and the orbiting wrap 144, which may be engaged with the fixed wrap 136. A rotation shaft coupling portion 146, which may be in an approximately circular shape, may be formed in a central portion of the disk 142, such that the eccentric bearing 128 may be rotatably inserted therein. An outer circumferential portion of the rotation shaft coupling portion 146 may be connected to the orbiting wrap 144 so as to define compression chambers together with the fixed wrap 136 during compression.

The eccentric bearing 128 may be inserted into the rotation shaft coupling portion 146, the end portion of the rotation shaft 126 may be inserted through the disk 134 of the fixed scroll 130, and the orbiting wrap 144, the fixed wrap 136, and the eccentric bearing 128 may overlap together in a lateral direction of the compressor. Upon compression, a repulsive force of a refrigerant may be applied to the fixed wrap 136 and the orbiting wrap 144, while a compression force as a reaction force against the repulsive force may be applied between the rotation shaft coupling portion 146 and the eccentric bearing 128. As such, when the shaft is partially inserted through the disk and overlaps with the wraps, the repulsive force of the refrigerant and the compression force may be applied at or to the same side surface of the disk, thereby being attenuated by each other. Consequently, the orbiting scroll 140 may be prevented from being inclined due to the compression force and the repulsive force. As alternate example, an eccentric bushing may be used instead of the eccentric bearing. In this example, an inner surface of the rotation shaft coupling portion 146, in which the eccentric bushing may be inserted, may be configured to serve as a bearing. Other examples of installing a separate bearing between the eccentric bearing and the rotation shaft coupling portion may also be appropriate.

Further, a diameter of the pin portion 126*d*, which penetrates the disk 134 of the fixed scroll 130, may be smaller than a diameter-extended part (shaft portion) 126*c* of the rotation shaft 126. Accordingly, a diameter of the shaft insertion hole formed at or in the fixed scroll 130 may be reduced by that amount, which may prevent a strength of the fixed scroll 130 from being reduced due to the shaft insertion hole, and reduce or prevent any leaking of compressed refrigerant between the pin portion 126*d* and the shaft insertion hole.

Figure 4:
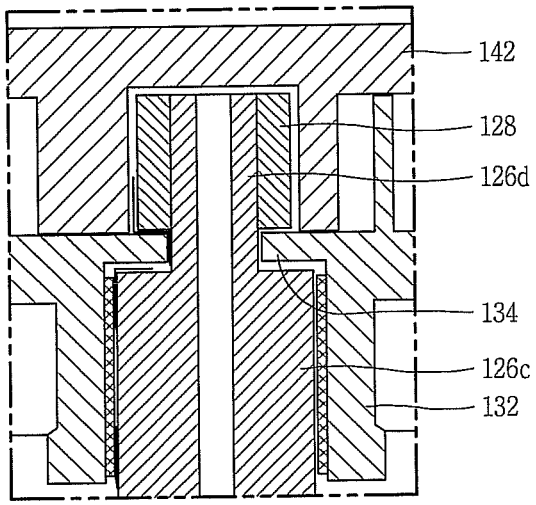
FIG. 4 is an enlarged partial sectional view showing a portion of the compression device of FIG. 2.

In particular, as shown in FIG. 4, the disk 134 of the fixed scroll 130 may be secured between an end of the pin portion 126*d* and an end of the eccentric bearing 128, so refrigerant may flow along a path indicated with an arrow to be leaked out of the compression chamber. Hence, the leakage path can be extended, in comparison to the related art scroll compressor in which the shaft portion penetrates directly through the disk, and thereby the leakage prevention effect may be improved.

The eccentric bearing 128 may also function as a bearing for smooth rotation of the orbiting scroll 140. In addition, a separate bearing may be installed at an outer circumferential portion of the eccentric bearing 128.

Although not shown, a discharge hole, through which compressed refrigerant may flow into the casing 110, may be formed through the disk 142. The position of the discharge hole may be set by considering, for example, a required discharge pressure.

An Oldham ring 150 that prevents rotation of the orbiting scroll 140 may be installed on the orbiting scroll 140. The Oldham ring 150 may include a ring portion 152, which may have an approximately circular shape, and may be inserted onto a rear surface of the disk 142 of the orbiting scroll 140, and a pair of first keys 154 and a pair of second keys 156 that protrude from one side surface of the ring part 152. The first pair of keys 154 may protrude longer than a thickness of an outer circumferential portion of the disk 142 of the orbiting scroll 140, and may be inserted into first key recesses 137, which may be recessed into an upper end of the side wall 138 of the fixed scroll 130 and the orbiting scroll support 138*a*.

The second pair of keys 156 may be inserted into second key recesses 147, which may be formed at or in the outer circumferential portion of the disk 142 of the orbiting scroll 140.

Each of the first key recesses 137 may have a first or vertically extending portion 137*a* that extends upwardly and a second or horizontally extending portion 137*b* that extends in a right-left direction. During an orbiting motion of the orbiting scroll 140, a lower end portion of each of the pair of first keys 154 may remain inserted in the horizontally extending portion 137*b* of the corresponding first key recess 137, while an outer end portion of the first key 154 may be separated in a radial direction from the vertically extending portion 137*a* of the first key recess 137. That is, the first key recesses 137 and the fixed scroll 130 may be coupled to each other in a perpendicular direction, which may allow reduction of a diameter of the fixed scroll 130.

In more detail, a clearance (air gap) as wide as an orbiting radius may be provided between the disk 142 of the orbiting scroll 140 and an inner wall of the fixed scroll 130. If the Oldham ring 150 is coupled to the fixed scroll 130 in a radial direction, the key recesses 137 formed at or in the fixed scroll 130 may be longer than at least the orbiting radius in order to prevent the Oldham ring 150 from being separated from the key recesses 137 during the orbiting motion. However, this structure may cause an increase in size of the fixed scroll. On the other hand, as shown in the exemplary embodiment, if the key recesses 137 extend down to a lower side of a space between the disk 142 of the orbiting scroll 140 and the orbiting wrap 144, a sufficient length of the key recess 137 may be ensured even without increasing the size of the fixed scroll 130.

In addition, in the exemplary embodiment, all of the keys of the Oldham ring 150 may be formed at or on the one side surface of the ring portion 152. This structure may thus reduce a perpendicular height of a compression device in comparison to forming keys at both side surfaces.

A lower frame 160 that rotatably supports a lower side of the rotation shaft 126 may be installed at a lower side of the casing 110, and an upper frame 170 that supports the orbiting scroll 140 and the Oldham ring 150 may be installed on the orbiting scroll 140. A hole may be provided at a central portion of the upper frame 170. The hole may communicate with the discharge hole of the orbiting scroll 140 to allow compressed refrigerant to be discharged toward the upper shell 112. Further, scrolls, such as for example, one or more elastic o-rings, may be provided between the orbiting scroll and the upper frame 170.

The exemplary embodiment shows that the pin portion 126*d* and the shaft portion may be integrally formed. However, embodiments are not limited to such structure. As an alternative example, the eccentric bearing 128 and the pin portion 126*d* may be integrally formed and the pin portion 126*d* may be inserted into the shaft portion.

Figure 5:
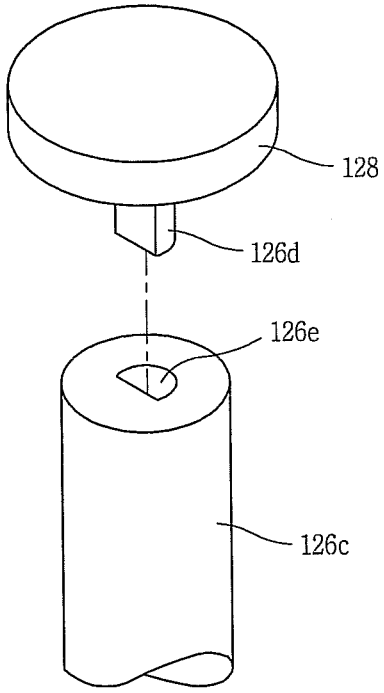
FIG. 5 is a disassembled perspective view showing a rotation shaft according to another embodiment.

FIG. 5 is a disassembled perspective view showing a rotational shaft according to another embodiment. As shown in FIG. 5, the eccentric bearing 128 and the pin portion 126*d* may be integrally formed to have a shape similar to the letter "T", and a pin fixing groove 126*e* may be formed at an end of the shaft portion 126*c*, such that the pin portion 126*d* may be inserted therein. Sections of the pin portion 126*d* and the pin fixing groove 126*e* may have a shape similar to the letter "D", so as to prevent the pin portion 126*d* from being rotated within the pin fixing groove 126*e*. Also, the pin portion 126*d* shown in FIG. 1 may penetrate the disk 134 of the fixed scroll 130; however, embodiments are not limited to this structure.

Figure 6:
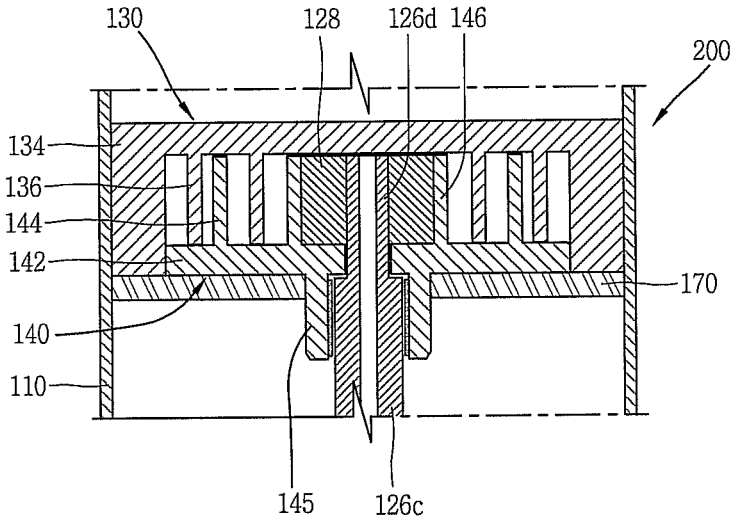
FIG. 6 is a partial sectional view showing a rotation shaft according to another embodiment.

FIG. 6 is a partial sectional view showing a rotation shaft according to another embodiment. In the embodiment of FIG. 6, like reference numerals have been used to indicate like elements, and repetitive disclosure has bee omitted. Further, the pin portion 126*d* of the scroll compressor 200 may penetrate the disk 142 of the orbiting scroll 140. Referring to FIG. 6, the fixed scroll 130 including the disk 134 and the fixed wrap 136 may be fixed onto an inner wall of the casing 110. The fixed wrap 136 of the fixed scroll 130 may be located at a lower portion of the disk 134, unlike the structure in FIG. 1.

The orbiting scroll 140 may be disposed beneath the fixed scroll 130. The upper frame 70 may be disposed below the orbiting scroll 142, as shown in FIG. 6. The orbiting wrap 144, which may be engaged with the fixed wrap 136 to define a compression chamber, may be disposed at an upper portion of the disk 142 of the orbiting scroll 140. The rotation shaft coupling portion 146, to which the rotation shaft may be coupled, may be formed at a central portion of the orbiting wrap 140. A boss 145, in which the shaft portion 126*c* of the rotation shaft may be rotatably inserted, may be formed at a lower portion of the rotation shaft coupling portion 146. A shaft insertion hole, through which the pin portion 126*d* of the rotation shaft 126 may be inserted, may be formed through the disk 142 located between the boss 145 and the rotation shaft coupling portion 146.

Therefore, the exemplary embodiment of FIG. 6 is different from the exemplary embodiment of FIG. 1, in that the shaft portion 126*c*, the pin portion 126*d*, and the eccentric bearing 128 of the rotation shaft 126 may all be coupled onto the orbiting scroll 140 without being coupled to the fixed scroll 130.

Hereinafter, description will be given of an orbiting wrap and a fixed wrap, each having an involute form according to embodiments.

Figure 7A:
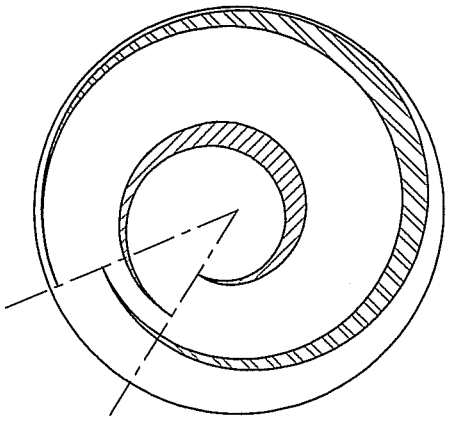
FIGS. 7A and 7B are planar views showing first and second compression chambers right after suction and right before discharge in a scroll compressor including an orbiting wrap and a fixed wrap having involute shape.
Figure 7B:
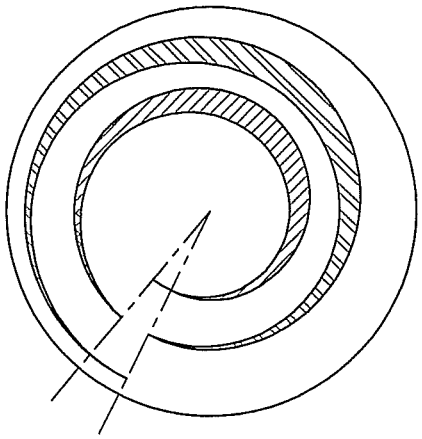

FIGS. 7A and 7B are planar views showing a compression chamber right after a suction operation and a compression chamber right before a discharge operation in a scroll compressor having an orbiting wrap and a fixed wrap formed as an involute curve and having a shaft partially inserted through a disk. In particular, FIG. 7A shows the change of a first compression chamber defined between an inner side surface of the fixed wrap and an outer side surface of the orbiting wrap, and FIG. 7B shows the change of a second compression chamber defined between an inner side surface of the orbiting wrap and an outer side surface of the fixed wrap.

In such a scroll compressor, a compression chamber is defined between two contact points generated by contact between the fixed wrap and the orbiting wrap. In a case in which the fixed wrap and the orbiting wrap have an involute curve shape, as shown in FIGS. 7A and 7B, the two contact points defining one compression chamber are on the same line. In other words, the compression chamber may extend 360° about a center of the rotation shaft.

Regarding a volume change of the first compression chamber, shown in FIG. 7A, a volume of the first compression chamber is gradually reduced as it moves toward a central portion in response to the orbiting motion of the orbiting scroll. Thus, when arriving at an outer circumferential portion of a rotation shaft coupling portion located at a center of the orbiting scroll, the first compression chamber has a minimum volume value. For the fixed wrap and the orbiting wrap having the involute curve shape, the volume reduction rate linearly decreases as an orbiting angle (hereinafter, referred to as a 'crank angle') of the rotation shaft increases. Hence, to acquire a high compression ratio, the first compression chamber should be moved as close to the center as possible. However, when the rotation shaft is present at the central portion, the compression chamber may only move up to the outer circumferential portion of the rotation shaft. Accordingly, the compression ratio is lowered. A compression ratio of about 2.13 is exhibited in FIG. 7A.

Meanwhile, the second compression chamber, shown in FIG. 7B, has a compression ratio of about 1.46, which is lower than that of the first compression chamber. However, regarding the second compression chamber, if the shape of the orbiting scroll is changed such that a connected portion between a rotation shaft coupling portion and the orbiting wrap is formed in an arcuate shape, a compression path of the second compression chamber before a discharge operation may be extended, thereby increasing the compression ratio up to about 3.0. In this case, the second compression chamber may extend less about 360° about the center of rotation of the rotation shaft right before the discharge operation. However, this method may not be applied to the first compression chamber.

Therefore, when the fixed wrap and the orbiting wrap have the involute curve shape, a compression ratio of the second compression chamber may be as high as possible, but a compression ratio of the first compression chamber may not. Also, when the two compression chambers have a significant difference between their respective compression ratios, it may adversely affect the operation of the compressor and may lower the overall compression ratio.

To solve this problem, the exemplary embodiment shown in FIGS. 9A-9E includes a fixed wrap and an orbiting wrap having a different curve (shape) from an involute curve. That is, FIGS. 9A to 9E show a process of determining shapes of the fixed wrap and the orbiting wrap according to the exemplary embodiment. In FIGS. 9A-9E, a solid line indicates a generated curve for the first compression chamber and a dotted line indicates a generated curve for the second compression chamber.

The generated curve refers to a track drawn by a particular shape during movement. The solid line indicates a track drawn by the first compression chamber during suction and discharge operations, and the dotted line indicates the track of the second compression chamber. Hence, if the generated curve is extended outward from its two opposite sides along the orbiting radius of the orbiting scroll based upon the solid line, it represents shapes of an inner side surface of the fixed wrap and an outer side surface of the orbiting wrap. If the generated curve is extended outward to its two opposite sides based upon the dotted line, it represents shapes of an outer side surface of the fixed wrap and an inner side surface of the orbiting wrap.

Figure 8A:
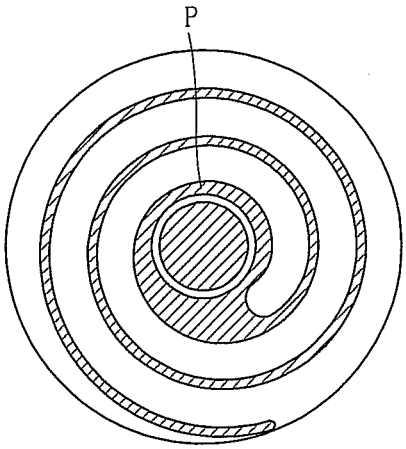
FIGS. 8A and 8B are planar views showing a shape of an orbiting wrap in a scroll compressor having an orbiting wrap and a fixed wrap in another involute shape.
Figure 8B:
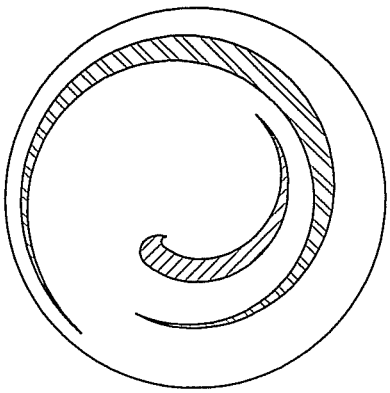
Figure 9A:
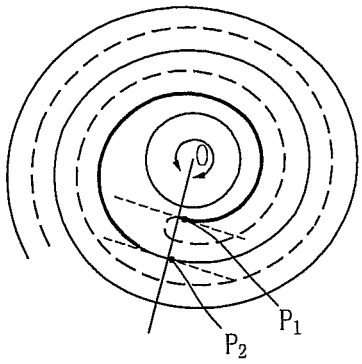
FIGS. 9A-9E illustrate a process for generating curves for the scroll compressor of FIG. 1.
Figure 9B:
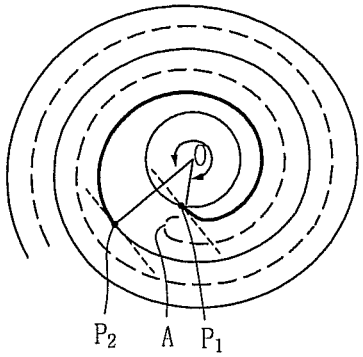

FIG. 9A shows a generated curve corresponding to a wrap shape shown in FIG. 8A. In FIG. 9A, the bold line corresponds to the first compression chamber right before a discharge operation. As shown, a start point and an end point are present on the same line. In this case, it may be difficult to achieve a sufficient compression ratio. Thus, as shown in FIG. 9B, an end portion of the bold line, the outer end portion, may be transferred or shifted in a clockwise direction along the generated curve, and the other end portion, the inner end portion, may be transferred or shifted to a point to contact the rotation shaft coupling portion. That is, a portion of the generated curve, adjacent to the rotation shaft coupling portion, may be curved so as to have a smaller radius of curvature.

As described above, the compression chamber may be defined by two contact points at which the orbiting wrap and the fixed wrap contact each other. The two ends of the bold line in FIG. 9A correspond to the two contact points. Normal vectors at the respective contact points are in parallel to each other according to the operating algorithm of the scroll compressor. Also, the normal vectors are in parallel to a line connecting a center of the rotation shaft and a center of the eccentric bearing. For a fixed wrap and an orbiting wrap having an involute curve shape, the two normal vectors are in parallel to each other and also present on the same line, as shown in FIG. 9A.

That is, if it is assumed that the center of the rotation shaft coupling portion 146 is O and the two contact points are P1 and P2, P2 is located on a line connecting O and P1. If it is assumed that a larger angle of the two angles formed by lines OP1 and OP2 is $\alpha$, $\alpha$ is 360°. In addition, if it is assumed that a distance between the normal vectors at P1 and P2 is l, l is 0.

When P1 and P2 are transferred more internally along the generated curves, the compression ratio of the first compression chamber may be improved. To this end, when P2 is transferred or shifted toward rotation shaft coupling portion 146, namely, the generated curve for the first compression chamber is transferred or shifted toward thoiohaft coupling portion 146, P1, which has a normal vector in parallel to the normal vector at P2, then rotates in a clockwise direction from the position shown in FIG. 9A to the position shown in FIG. 9B, thereby being located at the rotated point. As described above, the first compression chamber is reduced in volume as it is transferred or shifted more internally along the generated curve. Hence, the first compression chamber shown in FIG. 9B may be transferred or shifted more internally as compared to FIG. 9A, and further compressed a corresponding amount, thereby obtaining an increased compression ratio.

Figure 9C:
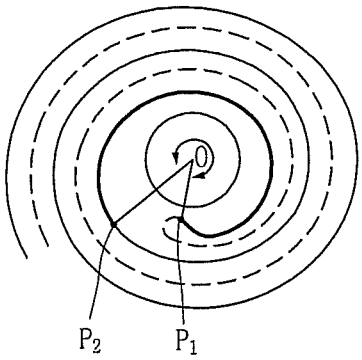
Figure 9D:
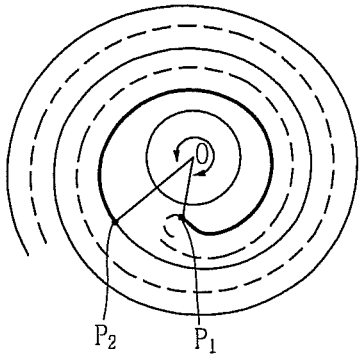

Referring to FIG. 9B, the point P1 may be considered excessively close to the rotation shaft coupling portion 146. Accordingly, the rotation shaft coupling portion 146 may have to become thinner to accommodate this. Hence, the point P1 is transferred back so as to modify the generated curve, as shown in FIG. 9C. In FIG. 9C, the generated curves of the first and second compression chambers may be considered to be excessively close to each other, which corresponds to an excessively thin wrap thickness or renders it physically too difficult to form the wrap(s). Thus, as shown in FIG. 9D, the generated curve of the second compression chamber may be modified such that the two generated curves maintain a predetermined interval therebetween.

Figure 9E:
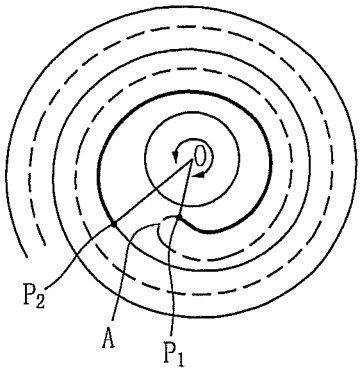

Further, the generated curve of the second compression chamber may be modified, as shown in FIG. 9E, such that an arcuate portion C located at the end of the generated curve of the second compression chamber may contact the generated curve of the first compression chamber. The generated curves may be modified to continuously maintain a predetermined interval therebetween. When a radius of the arcuate portion C of the generated curve of the second compression chamber is increased to ensure a wrap rigidity at the end of the fixed wrap, generated curves having the shape shown in FIG. 10 may be acquired.

Figure 10:
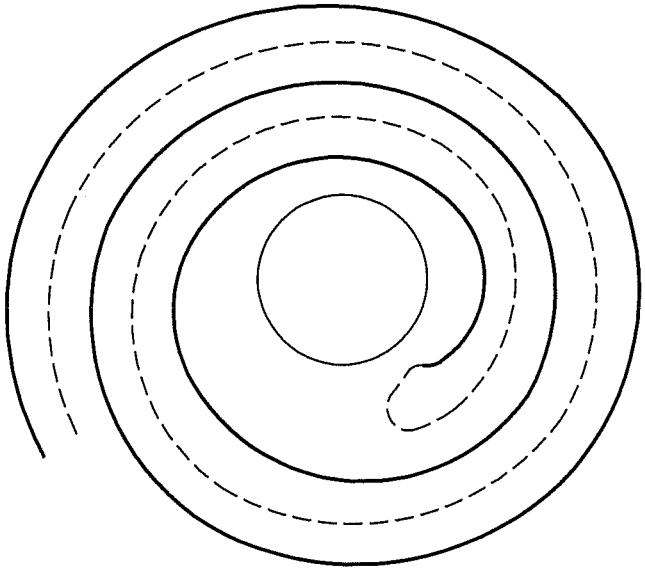
FIG. 10 is a planar view showing final curves generated as shown in FIGS. 9A-9E.
Figure 11:
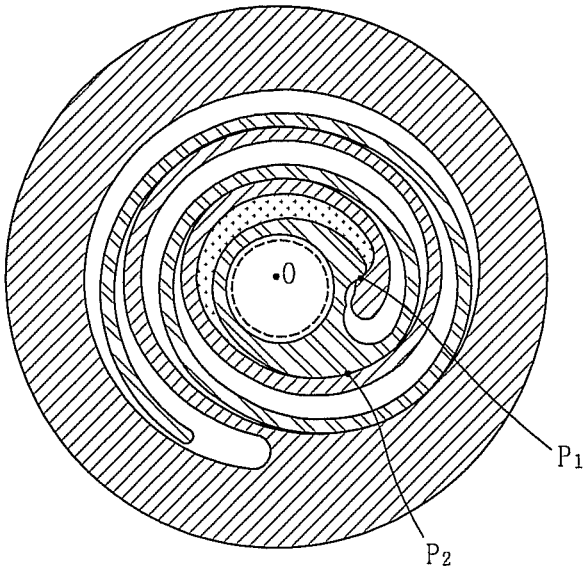
FIG. 11 is a planar view showing an orbiting wrap and a fixed wrap formed using the generated curves of FIG. 10.
Figure 12:
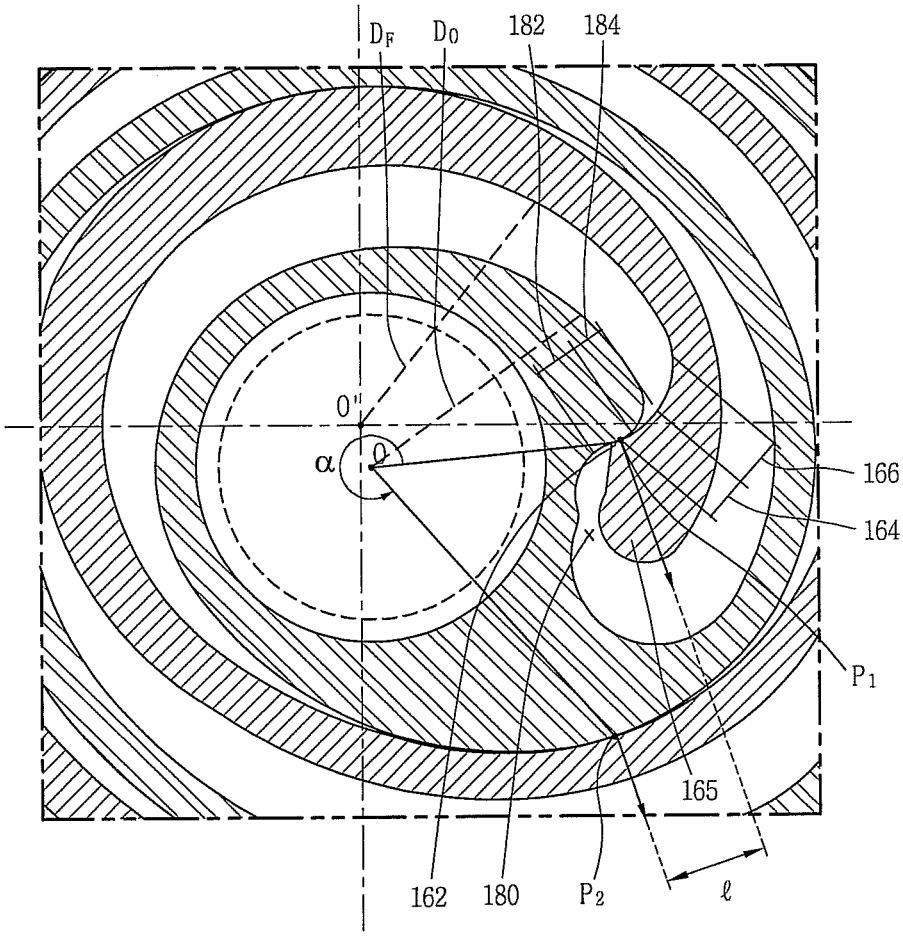
FIG. 12 is an enlarged planar view of a central portion of the orbiting wrap and fixed wrap of FIG. 11.

FIG. 11 is a planar view showing an orbiting wrap and a fixed wrap obtained based on the generated curves of FIG. 10, and FIG. 12 is an enlarged planar view of the central portion of FIG. 11. For reference, FIG. 11 shows a position of the orbiting wrap at a time point of initiating the discharge operation in the first compression chamber. The point P1 in FIG. 11 indicates a point of two contact points defining a compression chamber, at a moment when initiating discharging in the first compressor chamber. Line S is a virtual line that indicates a position of the rotation shaft and Circle C is a track drawn by the line S. Hereinafter, the crank angle is set to 0° when the line S is present in a state shown in FIG. 11, namely, when initiating discharging, set to a negative (−) value when rotated counterclockwise, and set to a positive (+) value when rotated clockwise.

Referring to FIGS. 11 and 12, an angle α defined by the two lines which respectively connect the two contact points P1 and P2 to the center O of the rotation shaft coupling portion may be smaller than about 360°, and a distance l between the normal vectors at each of the contact points P1 and P2 may be greater than about 0. Accordingly, the first compression chamber right before a discharge operation may have a smaller volume than that defined by the fixed wrap and the orbiting wrap having the involute curve shape, which results in an increase in the compression ratio. In addition, the orbiting wrap and the fixed wrap shown in FIG. 11 have a shape in which a plurality of arcs having different diameters and origins are connected and the outermost curve may have an approximately oval shape with a major axis and a minor axis.

Figure 13:
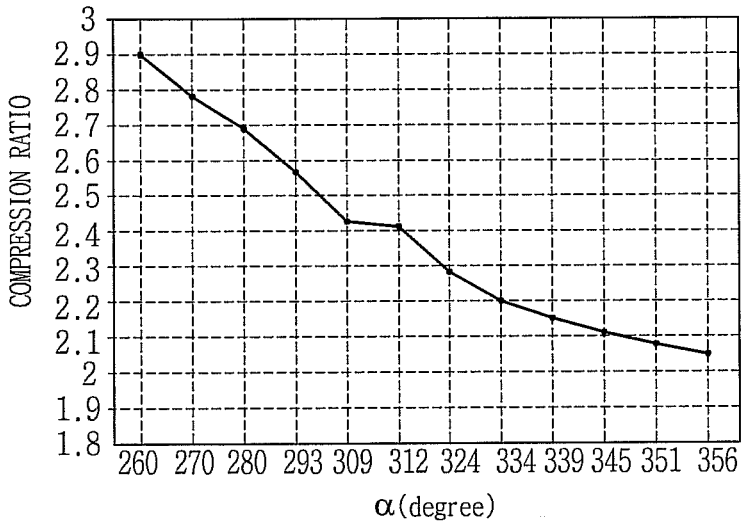
FIG. 13 is a graph showing a relationship between an angle $\alpha$ and a compression ratio.

In the exemplary embodiment, the angle α may be in the range of, for example, approximately 270° to 345°. FIG. 13 is a graph showing the angle α and the compression ratio. From the perspective of improvement of the compression ratio, it may be advantageous to set the angle α to have a low value. However, if the angle α is smaller than approximately 270°, it may cause mechanical fabrication, make production and assembly difficult, and increase a price of the compressor. If the angle α exceeds approximately 345°, the compression ratio may be lowered below 2.1, thereby failing to provide a sufficient compression ratio.

In addition, a protruding portion 165 may protrude from an inner end of the fixed wrap toward the rotation shaft coupling portion 146. A contact portion 162 may be formed at the end of the protruding portion 165. That is, the inner end of the fixed wrap 130 may be thicker than other portions. Accordingly, a wrap rigidity of the inner end of the fixed wrap, to which the strongest compression force may be applied, may be improved, resulting in enhancing durability.

The thickness of the fixed wrap may be gradually decreased, starting from the inner contact point P1 of the two contact points defining the first compression chamber upon initiating the discharge operation, as shown in FIG. 12. More particularly, a first decrease portion 164 may be formed adjacent to the contact point P1 and a second decrease portion 166 may extend from the first decrease portion 164. A thickness reduction rate of the first decrease portion 164 may be higher than that of the second decrease portion 166. After the second decrease portion 166, the fixed wrap may be increased in thickness within a predetermined interval.

Figure 14:
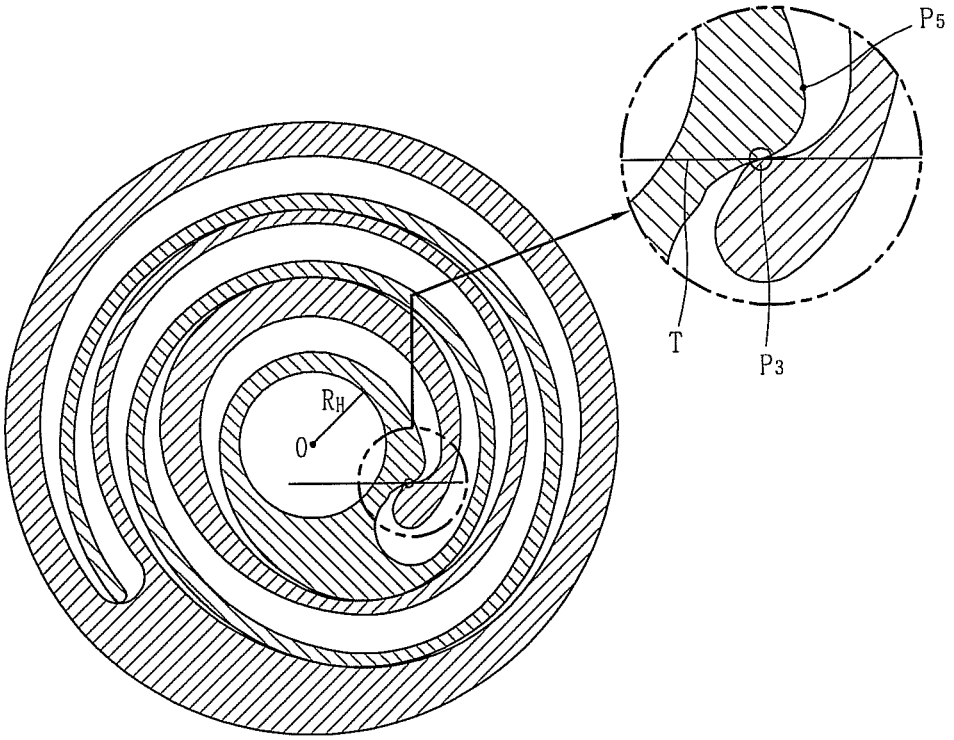
FIG. 14 is another planar view showing an enlarged central portion of FIG. 11.
Figure 17:
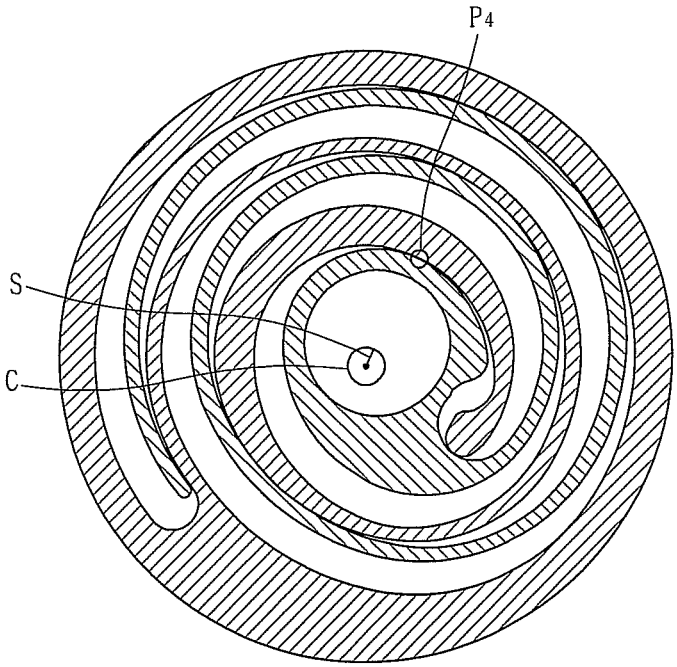
FIG. 17 is a planar view showing a state in which a crank angle is located at approximately 150°.

If it is assumed that a distance between an inner side surface of the fixed wrap and a center O of the rotation shaft is DF, then DF may be increased and then decreased as it progresses away from P1 in a counterclockwise direction (based on FIG. 12), and such interval is shown in FIG. 17. FIG. 17 is a planar view showing the position of the orbiting wrap 150° before initiating the discharge operation, namely, when the crank angle is about 150°. If the rotation shaft rotates about 150° from the state of FIG. 17, it reaches the state shown in FIG. 11. Referring to FIG. 14, an inner contact point P5 of two contact points defining the first compression chamber is located above the rotation shaft coupling portion 146, and the DF is increased and then decreased at the interval from P3 of FIG. 14 to P4 of FIG. 17.

The rotation shaft coupling portion 146 may be provided with a recess portion 180 to be engaged with the protruding portion 165. One side wall of the recess portion 180 may contact the contact portion 162 of the protruding portion 165 to define one contact point of the first compression chamber. If it is assumed that a distance between the center of the rotation shaft coupling portion 146 and an outer circumferential portion of the rotation shaft coupling portion 146 is Do, then Do may be increased and then decreased at the interval between P1 of FIG. 9 and P4 of FIG. 17. Similarly, the thickness of the rotation shaft coupling portion 146 may also be increased and then decreased at the interval between P1 of FIG. 11 and P4 of FIG. 17.

The one side wall of the recess portion 180 may include a first increase portion 182 at which a thickness is relatively significantly increased, and a second increase portion 184 extending from the first increase portion 182 and having a thickness increased at a relatively low rate. These correspond to the first decrease portion 164 and the second decrease portion 166 of the fixed wrap. The first increase portion 182, the first decrease portion 164, the second increase portion 184, and the second decrease portion 166 may be obtained by turning the generated curve toward the rotation shaft coupling portion 146 at the step of FIG. 9B. Accordingly, the inner contact point P1 defining the first compression chamber may be located at the first and second increase portions, and also the length of the first compression chamber right before the discharge operation may be shortened so as to enhance the compression ratio.

Another side wall of the recess portion 180 may have an arcuate shape. A diameter of the arc may be decided by the wrap thickness of the end of the fixed wrap and the orbiting radius of the orbiting wrap. When the thickness of the end of the fixed wrap increases, the diameter of the arc may increase. Accordingly, the thickness of the orbiting wrap near the arc may increase to provide durability and the compression path may also extend so as to increase the compression ratio of the second compression chamber.

Figure 18:
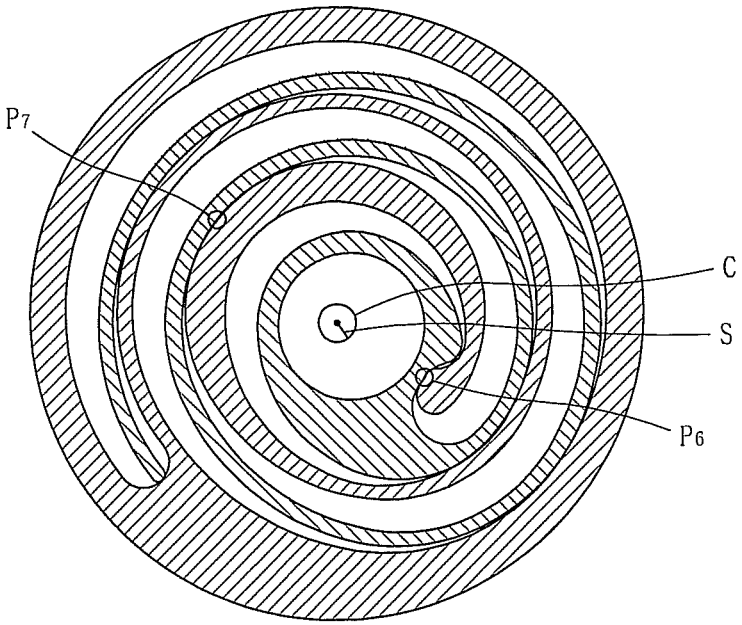
FIG. 18 is a planar view showing initiation of a discharge operation in a second compression chamber in the embodiment of FIG. 11.

The central portion of the recess portion 180 may form a part of the second compression chamber. FIG. 18 is a planar view showing the position of the orbiting wrap when initiating the discharge operation in the second compression chamber. Referring to FIG. 18, the second compression chamber is defined between two contact points P6 and P7 and contacts an arcuate side wall of the recess portion 180. When the rotation shaft rotates further, one end of the second compression chamber may pass through the center of the recess portion 180.

FIG. 14 is another planar view showing a state corresponding to the state shown in FIG. 12. It may be noticed, referring to FIG. 14, that a tangent line T drawn at the point P3 (which corresponds to the point P1 in FIG. 11) passes through the inside of the rotation shaft coupling portion 146. This results from the generated curve being curved inwardly during the process of FIG. 9B. Consequently, a distance between the tangent line T and a center of the rotation shaft coupling portion 146 may be smaller than a diameter RH within the rotation shaft coupling portion.

Figure 15A:
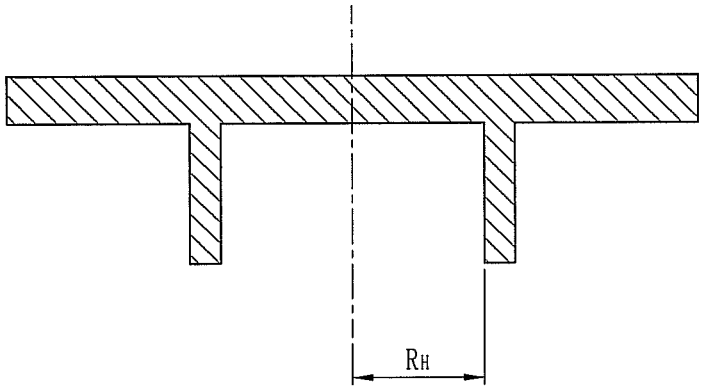
FIGS. 15A-15B are sectional views of a rotation shaft coupling portion according to embodiments.
Figure 15B:
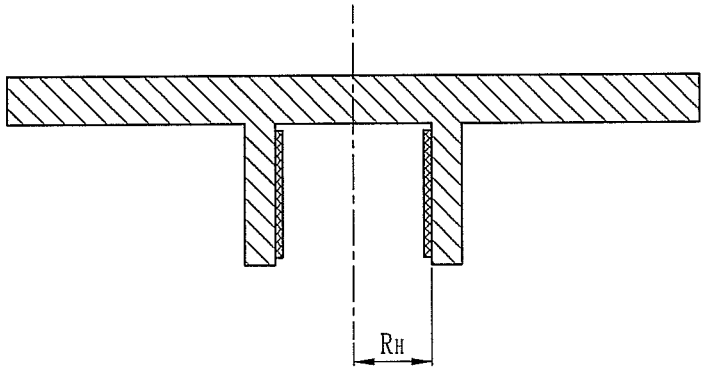

The inner diameter RH may be defined as an inner diameter of the rotation shaft coupling portion 146 when an inner circumferential surface of the rotation shaft coupling portion 146 or an outer circumferential surface of the eccentric bearing 128 is lubricated, as shown in FIG. 15A, without a separate bearing, whereas being defined as an outer diameter of the bearing when a separate bearing is additionally employed within the rotation shaft coupling portion 146, as shown in FIG. 15B.

In FIG. 14, the point P5 denotes an inner contact point when the crank angle is about 90°, and as shown, a radius of curvature of an outer circumference of the rotation shaft coupling portion may have various values depending on each position between the points P3 and P5. Here, the average radius of curvature Rm defined by the following equation may influence on the compression ratio of the first compression chamber.

$$R_m = \frac{1}{90}\int_0^{90} R_\theta \, d\theta$$

where Rθ is a radius of curvature of the orbiting wrap at the inner contact point of the first compression chamber when the crank angle is θ.

Figure 16:
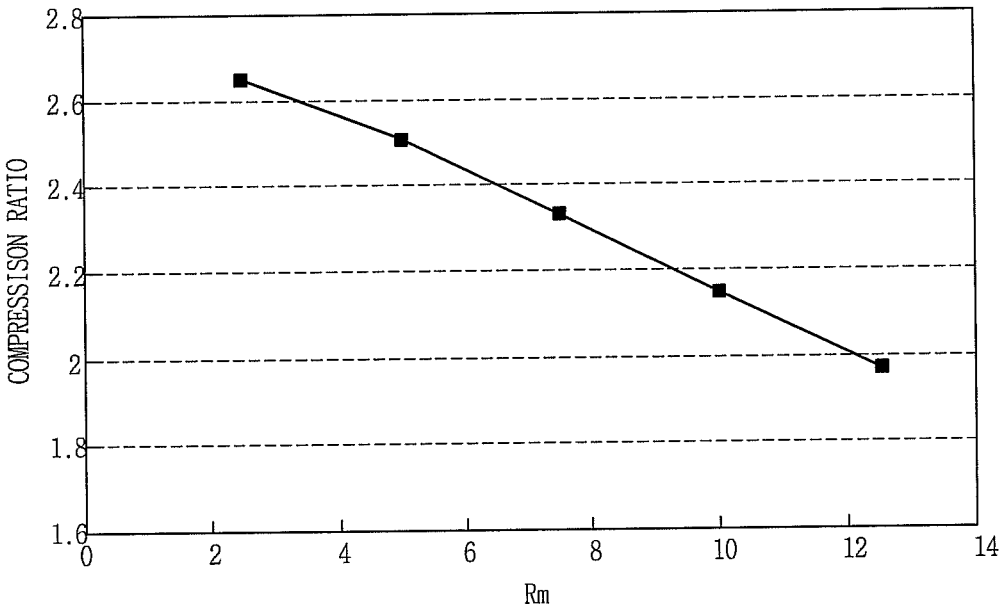
FIG. 16 is a graph showing change in compression ratio in response to an average radius of curvature.

FIG. 16 is a graph showing a relationship between an average radius of curvature and compression ratio. In general, a rotary compressor may preferably have a compression ratio more than about 2.3 when being used for both cooling and heating, and more than about 2.1 when being used for cooling. Referring to FIG. 16, when the average radius of curvature is less than about 10.5, the compression ratio may be more than about 2.1. Therefore, if Rm is set to be less than 10.5 mm, the compression ratio may be more than about 2.1. Here, the Rm may be optionally set to be suitable for the use of the scroll compressor. In the exemplary embodiment, the RH may have a value of approximately about 15 mm. Therefore, the Rm may be set to be smaller than RH/1.4.

Meanwhile, the point P5 may not always be limited when the crank angle is about 90°. In view of the operating algorithm of the scroll compressor, a design variable with respect to a radius of curvature after 90° is low. Accordingly, in order to improve a compression ratio, it is advantageous to change a shape between about 0° and 90°, in which the design variable is relatively high.

Embodiments disclosed herein provide a scroll compressor capable of minimizing a strength reduction of a disk of an orbiting scroll, even if the orbiting wrap and a rotation shaft are coupled to each other on a same side surface.

Embodiments disclosed herein provide a scroll compressor that may include a fixed scroll having a fixed wrap, an orbiting scroll engaged with the fixed wrap to define a compression chamber, a rotation shaft having a shaft portion eccentrically located from the orbiting scroll, a pin portion located at an end of the shaft portion and having a diameter smaller than that of the shaft portion, and a bush located at an end of the pin portion, and a drive to drive the rotation shaft, wherein the pin portion is inserted through one of the fixed scroll or the orbiting scroll, and the orbiting scroll is rotatably coupled to the bush.

A portion of the rotation shaft that penetrates the disk of the orbiting scroll may be formed to have a diameter smaller than other portions of the rotation shaft so that the size of the shaft insertion hole of the disk may be smaller in diameter than the shaft portion, which results in reduction in a lowered disk strength and a minimization of leakage of a refrigerant. Especially, the disk may be secured between the shaft portion and the bush, so that a refrigerant leakage path may be remarkably extended as compared to the related art, thereby minimizing leakage of refrigerant.

The pin portion and the shaft portion may be formed integrally with each other. With this structure, the pin portion may be inserted into the bush and fixed thereto. To this end, the bush may be fixed into the pin portion, for example, by welding or shrink-fitting. Alternatively, the pin portion may be formed to have a polygonal or non-circular section so that the bush inserted into the pin portion cannot rotate with respect to the pin portion. The pin portion may be coaxially disposed with respect to the shaft portion, and the bush may be eccentrically disposed with respect to the pin portion.

The pin portion and the bush may be integrally formed with each other. The pin portion may be inserted into the shaft portion and fixed thereto so as to be rotatable together with the shaft portion. The pin portion may have a section in a polygonal or non-circular shape. In addition, the pin portion may be coaxially disposed with respect to the shaft portion, and the bush may be eccentrically disposed with respect to the pin portion.

The portion of the rotation shaft penetrating the disk of the orbiting scroll may be formed to have a diameter smaller than other portions of the rotation shaft, thus a size of the shaft insertion hole of the disk may be smaller than the diameter of the shaft portion. Accordingly, the lowering of the strength of the disk may be reduced and leakage of the refrigerant may be minimized. Especially, the disk is secured between the shaft portion and the bush, so a refrigerant leakage path may be extended in comparison to the related art, thereby minimizing the fear for the refrigerant leakage.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a fixed scroll having a fixed wrap formed at an upper surface of a disk;

an orbiting scroll disposed on top of and engaged with the fixed wrap to define a plurality, of compression chambers;

an upper frame disposed above the orbiting scroll;

a rotational shaft comprising a shaft portion eccentrically located with respect to the orbiting scroll, a pin portion located at an end of the shaft portion and having a diameter smaller than a diameter of the shaft portion, and a bearing located at an end of the pin portion; and a drive that drives the rotation rotational shaft, wherein the pin portion is inserted through the orbiting fixed scroll, and the orbiting scroll is rotatably coupled to the bearing, wherein the pin portion is coaxially disposed with respect to the shaft portion, wherein a diameter of a shaft insertion hole of the disk is smaller than a diameter of the shaft portion, wherein the end of the shaft portion is disposed so as to face a lower surface of the disk, and the pin portion is inserted through the shaft insertion hole, and wherein the bearing is eccentrically disposed with respect to the pin portion.

2. The scroll compressor of claim 1, further comprising a high pressure chamber disposed above the upper frame.

3. The scroll compressor of claim 2, wherein, during operation, a high pressure fluid within the high pressure chamber pushes the orbiting scroll away from the upper frame, thereby reducing wear and noise.

4. The scroll compressor of claim 2, further comprising a discharge pipe that discharges a compressed refrigerant from the high pressure chamber.

5. The scroll compressor of claim 1, wherein the upper frame divides an inner area of the scroll compressor into a high pressure chamber and a low pressure chamber.

6. The scroll compressor of claim 5, wherein the high pressure chamber is disposed above the upper frame and the low pressure chamber is disposed below the upper frame.

7. The scroll compressor of claim 1, wherein the pin portion and the shaft portion are integrally formed with each other.

8. The scroll compressor of claim 7, wherein the pin portion is inserted into the bearing and fixed thereto.

9. The scroll compressor of claim 8, wherein the pin portion has a section in the form of a polygonal or non-circular shape.

10. The scroll compressor of claim 1, wherein the pin portion and the bearing are integrally formed with each other.

11. The scroll compressor of claim 10, wherein the pin portion is inserted into the shaft portion and fixed thereto so as to be rotatable together with the shaft portion.

12. The scroll compressor of claim 11, wherein the pin portion has a section in a polygonal or non-circular shape.

13. The scroll compressor of claim 1, wherein the disk is secured between the bearing and the shaft portion.

14. The scroll compressor of claim 13, wherein the diameter of the shaft insertion hole is as wide as a diameter of the pin portion.

15. A scroll compressor, comprising:

a fixed scroll having a fixed wrap formed at an upper surface of a disk;

an orbiting scroll engaged with the fixed wrap to define a plurality of compression chambers;

a high pressure chamber disposed above the fixed scroll;

a rotational shaft having a shaft portion eccentrically located with respect to the orbiting scroll, a pin portion located at an end of the shaft portion and having a diameter smaller than a diameter of the shaft portion, and a bearing located at an end of the pin portion; and a drive that drives the rotational shaft, wherein the pin portion is inserted through the fixed scroll, and the orbiting scroll is rotatably coupled to the bearing, wherein the pin portion is coaxially disposed with respect to the shaft portion, wherein a diameter of a shaft insertion hole of the disk is smaller than a diameter of the shaft portion, wherein the end of the shaft portion is disposed so as to face a lower surface of the disk, and the pin portion is inserted through the shaft insertion hole, and wherein the bearing is eccentrically disposed with respect to the pin portion.

16. The scroll compressor of claim 15, further comprising a discharge pipe that discharges a compressed refrigerant from the high pressure chamber.

17. The scroll compressor of claim 15, further comprising an upper frame disposed below the orbiting scroll.

18. The scroll compressor of claim 17, wherein the upper frame divides an inner area of the scroll compressor into the high pressure chamber and a low pressure chamber.

19. The scroll compressor of claim 15, wherein the pin portion and the shaft portion are integrally formed with each other.

20. The scroll compressor of claim 19, wherein the pin portion is inserted into the bearing and fixed thereto.

21. The scroll compressor of claim 15, wherein the disk is secured between the bearing and the shaft portion.

22. The scroll compressor of claim 21, wherein the diameter of the shaft insertion hole is as wide as the diameter of the pin portion.

* * * * *